United States Patent [19]

Matsumoto et al.

[11] 3,988,983

[45] Nov. 2, 1976

[54] TRANSFER MACHINE AND SYSTEM

[75] Inventors: Nobuo Matsumoto, Kurashiki; Yoshio Yoshimoto, Okayama; Tsutomu Miyake, Kurashiki; Gumpei Yokoyama, Kobe, all of Japan

[73] Assignees: Kawasaki Jukogyo Kabushiki Kaisha; Kawasaki Steel Corporation, both of Kobe, Japan

[22] Filed: June 18, 1975

[21] Appl. No.: 588,107

Related U.S. Application Data

[63] Continuation-in-part of Ser. No. 398,903, Sept. 19, 1973, abandoned.

[30] Foreign Application Priority Data

Sept. 25, 1972 Japan ..... 47-96357

[52] U.S. Cl. ..... 101/35; 427/289; 83/72; 83/926 R; 83/408; 83/407

[51] Int. Cl.[2] ..... B41F 19/00; B41K 3/68; B26D 7/06

[58] Field of Search ..... 101/35, 2; 83/79, 80, 83/106, 107, 71–74, 69, 367, 407, 408, 919, 926 R, 44, 47, 209, 210; 318/562, 563; 29/407; 427/289, 293; 403/3, 4, 70

[56] References Cited

UNITED STATES PATENTS

| | | | |
|---|---|---|---|
| 2,876,815 | 3/1959 | Rogers | 101/2 X |
| 3,264,916 | 8/1966 | Owen | 83/80 |
| 3,307,441 | 3/1967 | Saunders et al. | 83/106 X |
| 3,312,562 | 4/1967 | Miller | 427/289 |
| 3,488,479 | 1/1970 | Keyes et al. | 83/71 X |
| 3,543,392 | 12/1970 | Perry et al. | 29/563 |
| 3,559,256 | 2/1971 | Lemelson | 83/71 X |
| 3,576,540 | 4/1971 | Fair | 408/3 |
| 3,618,349 | 11/1971 | Roch | 83/71 |
| 3,743,259 | 7/1973 | Hennelly | 266/23 R |
| 3,811,353 | 5/1974 | Miles | 83/71 |

*Primary Examiner*—E. H. Eickholt
*Attorney, Agent, or Firm*—Sughrue, Rothwell, Mion, Zinn & Macpeak

[57] ABSTRACT

A transfer machine and system is disclosed which automatically performs a series of marking, cutting, sorting, and the like operations in the manufacture of a large number of test material samples. The transfer machine operates under the control of a card or tape reader which provides coded information such as marking indicia, pattern number and thickness of the material for each test sample. This information is encoded, temporarily stored and then shifted in a series of parallel shift registers in sequence with the corresponding test sample as it progresses through each stage of the transfer machine. The contents of the shift registers at each stage are decoded to provide the control signals for the corresponding marking, cutting, sorting, and similar operations. After the respective operations at each stage of the transfer machine have been completed, a coincidence signal is generated which causes the transfer machine to index thereby picking up a new test sample blank and discharging a completed test sample. Two lines of operation may progress simultaneously in which case a priority circuit is provided to direct new test sample blanks to whichever line has completed all operations at each respective stage in that line.

3 Claims, 21 Drawing Figures

FIG. 16
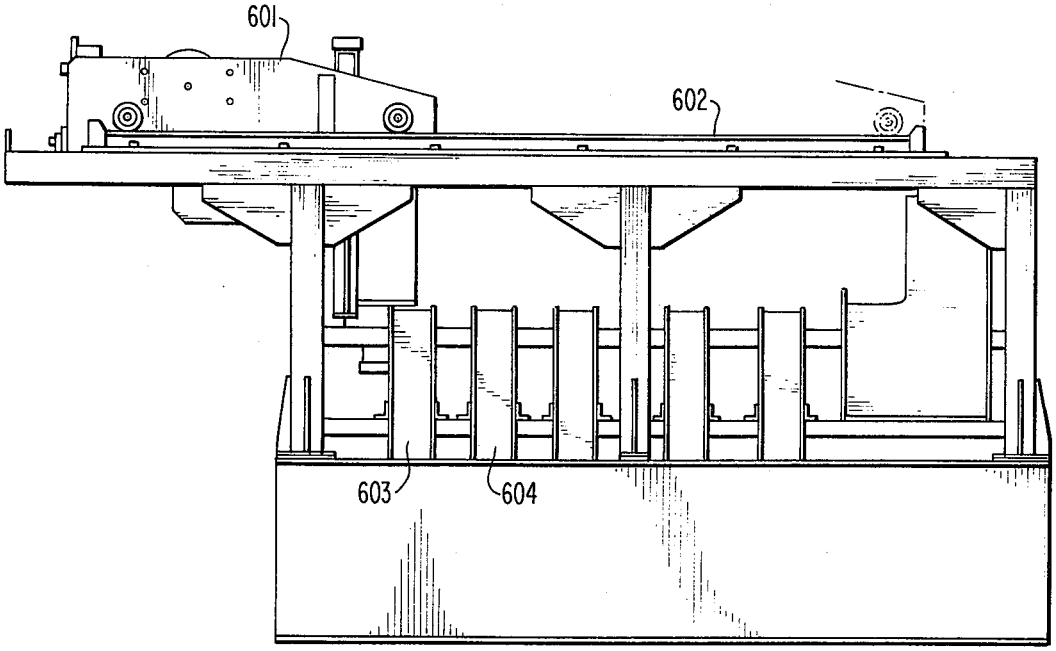
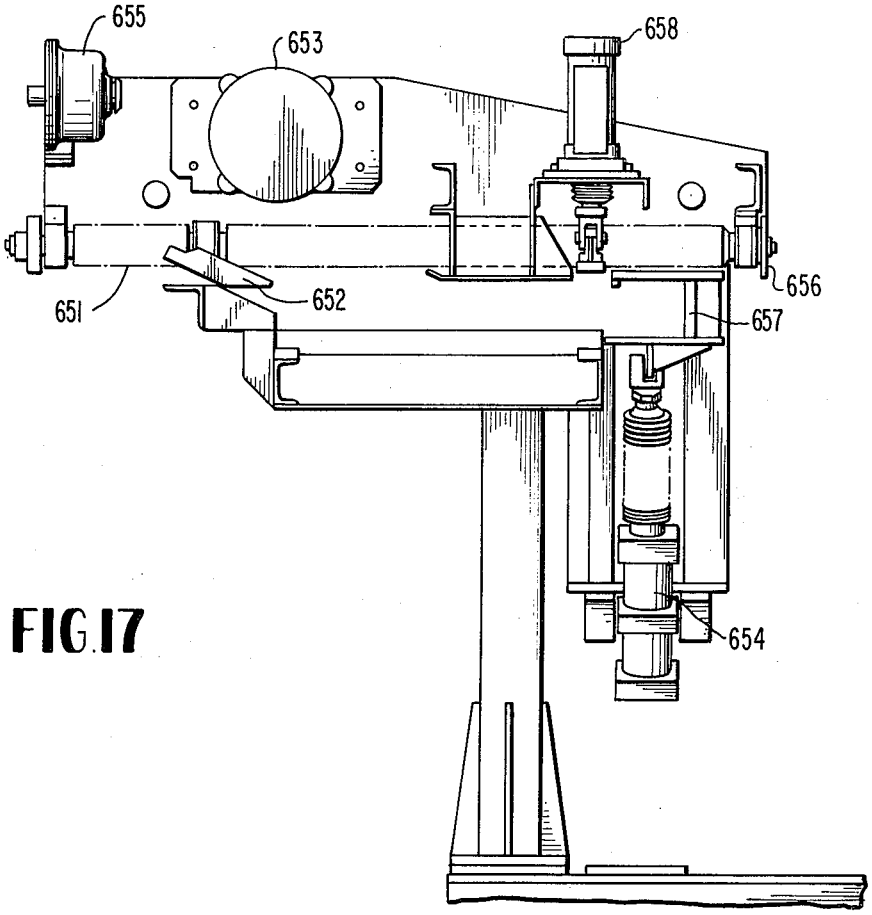
FIG. 17

TRANSFER MACHINE AND SYSTEM

CROSS REFERENCE TO RELATED APPLICATION

This is a continuation-in-part application Ser. No. 398,903, filed Sept. 19, 1973, entitled, "Transfer Machine and System", now abandoned.

BACKGROUND OF THE INVENTION

1. Field of the Invention

The present invention generally relates to automated manufacturing systems, and more particularly to a multiple line transfer machine and system which automatically performs a series of marking, cutting, sorting and the like operations in the manufacture of a large number of test material samples.

2. Description of the Prior Art

It is conventional in the making a material testing samples to perform the following steps:

1. making a material test element from a matrix plate by shearing or gas cutting and marking a discrimination number, such as a plate number, on the test element,
2. verifying the element with a pattern book and marking cutting lines on the element as directed in the book to cut the element into the predetermined size of test pieces,
3. marking plate numbers on every test piece of the element with the marking of lines for cutting,
4. gas cutting the element marked with lines and plate numbers into the test pieces, and
5. sorting the test pieces cut from material test elements into classes.

These steps have all been performed manually, and accordingly a great deal of labor has been necessitated to make a large number of test pieces for mass production.

SUMMARY OF THE INVENTION

It is therefore an object of this invention to provide a system for making the operations required in the manufacture of a large number of material test samples completely automatic.

According to the invention, the foregoing and other objects are attained by providing a transfer machine and system wherein a series of various processing machines are arranged in one or more lines characterized in that after an element is fed into the transfer machine the element is automatically processed by the series of processing machines while the element is fed on a conveyer.

More concretely describing the present invention, a transfer machine and system is provided which automatically performs a series of operations, for example, for making a desired sample piece of thick steel plate from a sample steel element, and an object of the present invention is to save the work, enhance the efficiency and preciseness of the performance of the transfer machine.

BRIEF DESCRIPTION OF THE DRAWINGS

The specific nature of the invention, as well as other objects, aspects, uses and advantages thereof, will clearly appear from the following description and from the accompanying drawings, in which:

FIG. 13 is a front elevational view of a longitudinal slitting device;

FIG. 14 is a side elevational view of the longitudinal slitting device as shown in FIG. 13;

FIG. 16 shows a side elevation of a sorting device;

FIG. 17 is a sectional view of the sorting device of FIG. 16.

DESCRIPTION OF THE PREFERRED EMBODIMENT

Figure 1:
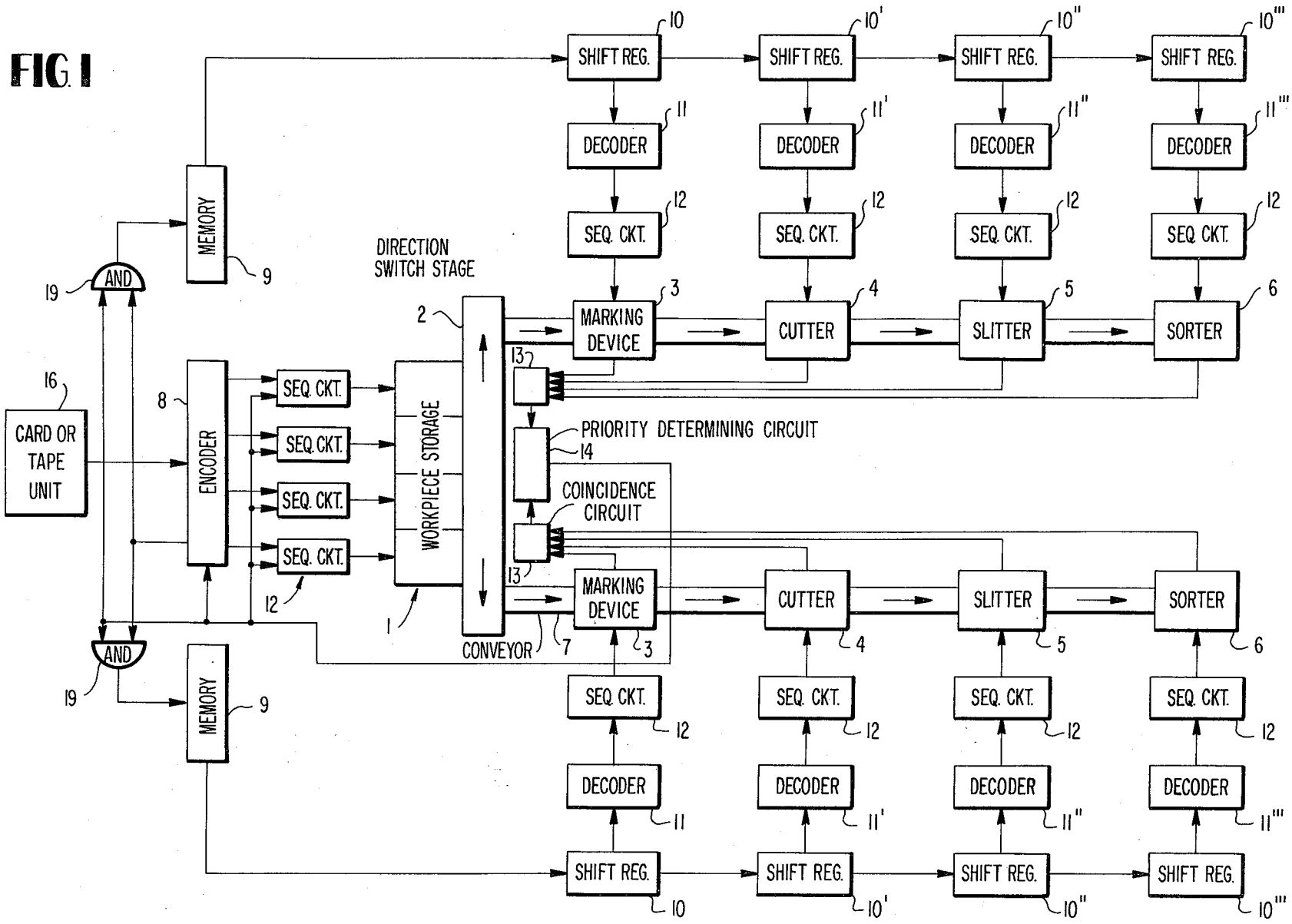
FIG. 1 is a block schematic diagram of the control system of a two-line transfer machine according to the invention.

Referring now to the drawings and more particularly to FIG. 1 which illustrates the system block diagram of the invention, the reference numeral 1 indicates a material preparation stage for storing several test piece elements (not shown); 2 indicates a direction switch stage for feeding the test piece elements to the first line or second line from the material preparation stage 1; 3 shows a marking device for printing letters indicating part of the input information such as month, date, plate number, presenting organization and test piece position; 4 indicates a cutter for gas cutting the element into test sample pieces; 5 indicates a longitudinal sitting device; 6 shows a sorter for classifying the test pieces into various sample pieces such as spare material, tension material, bending material and impact material; 7 shows a conveyor; and 8 indicates an encoder which reads an information signal from a card or tape input unit 16 such as a pattern number defining cutting, shape, tension, bending, impact and spare material, plate thickness, marking letters, material hardness and converting the input information signal into a transmission signal. The reference numeral 9 indicates a temporary memory device which stores the information signal; 10, 10′, 10″, 10‴ show parallel shift registers which successively shift said information signal every time the element is moved by the conveyer 7; 11, 11′, 11″,11‴ indicate decoders for reading signals from the parallel shift registers for control of the marking device, cutting device, longitudinal slitting device, and sorter. The decoder 11 reads the signal which identifies the marking letters and hardness of the material and generates an output for selecting letters to be marked device 3 and an output for switching the marking pressure (hydraulic pressure) according to the hardnesss of the material to be processed. The decoders 11' and 11'' read the signal corresponding to the thickness, hardness of the material and pattern number, and generate outputs for the operation of the cutting and slitting devices 4 and 5 such as an output for returning the cutting stage to the original point determined by the thickness of the plate to be processed, an output for selecting the gas pressure for gas cutting, an output for selecting the diameter of the torch nozzle and the height of the torch nozzle, and an output for setting the width of the slitting by reading the signal concerning the pattern number. The decoder 11''' reads the signal of the pattern number and generates an output for the operation of the sorter 6 for controlling the size of the test piece dropping chute mouth according to the size of the test piece. The reference numeral 12 shows a sequence circuit for controlling the drive of the work machines 3 to 6 by the outputs of the decoders 11 to 11'''. 12' indicates a sequence circuit for operating an element supply device (not shown) of the material preparing stage 1 by the output of the coincidence circuit 13 or a priority determining circuit 14 given through an encoder 8. 13 shows a concidence circuit which generates a work finish signal when each of the processing machines 3 to 6 finishes thereby controlling the supplying of subsequent elements and successively feeding the elements in process on conveyor 7 to the succeeding machines. The reference numeral 14 indicates a priority determining circuit feeding the new elements into the one of the two lines which earlier finished all processing operations.

Figure 6:
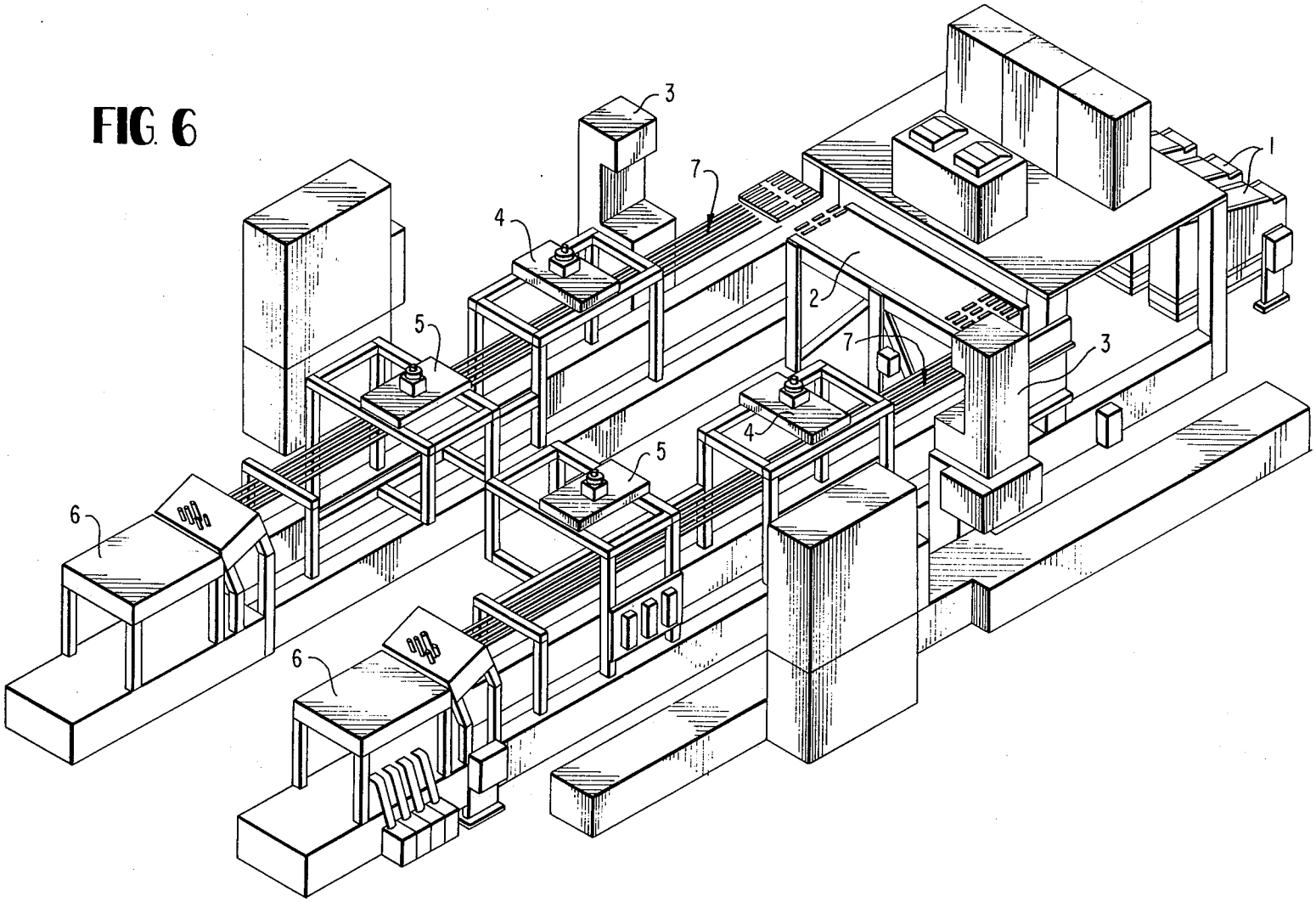
FIG. 6 is a perspective view showing a two-line transfer machine according to the invention.

The physical arrangement of the transfer machine as just described is illustrated in perspective view in FIG. 6 of the drawings. In FIG. 6, two lines are shown, and the same reference numerals used in FIG. 1 are used to denote identical or corresponding parts.

Figure 2:
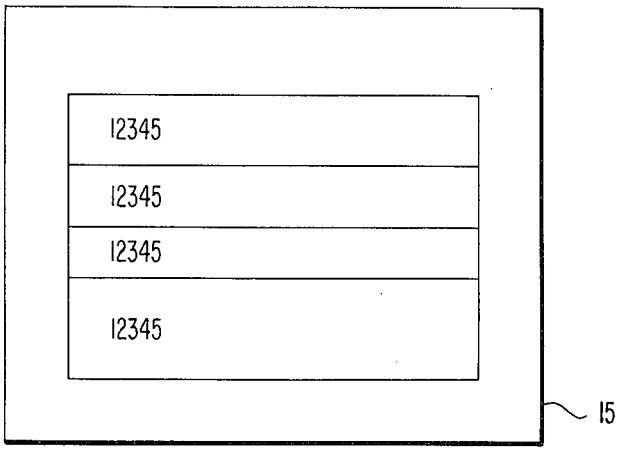
FIG. 2 is a plan view showing the geometry and marking of a test element in accordance with one example.
Figure 3A:
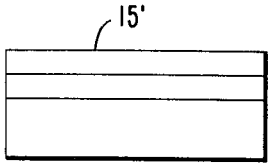
FIGS. 3A, 3B and 3C are plan views showing examples of patterns for test elements.
Figure 3B:
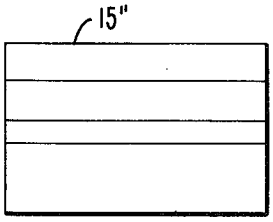
Figure 3C:
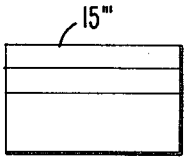
Figure 4:
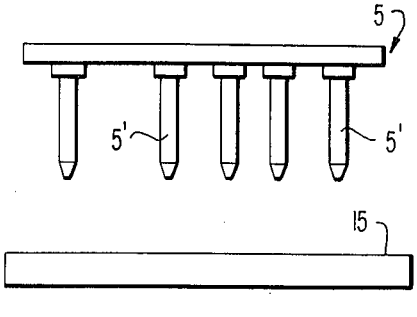
FIG. 4 is a side view showing an example of the postions of gas torches for cutting the patterns on the test elements.
Figure 5:
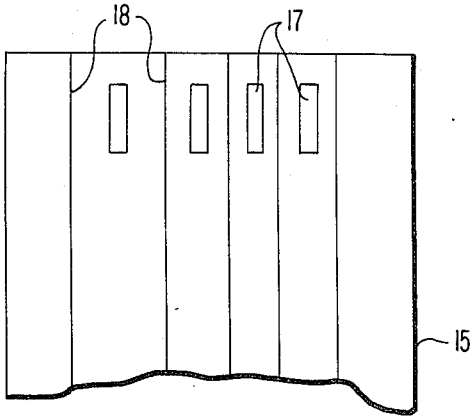
FIG. 5 is a partial plan view of a test piece showing the position of marking and the position of cutting.

The operation of the above embodiment will be described in the case that only the first line is operated. Now assuming that a plurality of elements as shown in FIG. 2 are located at the working machines 3 to 6 and all the work of the machines are coincidentally finished and an output is generated from the coincidence circuit 13, the output operates a material or element supply device by the circuit of the element supply device (not shown) of material preparing stage 1 by means of the sequence circuit 12'. This output further operates a driving device (not shown) for driving the direction switch stage 2 and the conveyor 7. Consequently, a new test piece 15 on the material preparing stage 1 is supplied to the direction switching stage 2 and fed to the marking device 3 along the arrow shown in the drawing from the direction switching stage 2. Simultaneously therewith, a test sample piece 15 marked by the marking device 3 is fed to the succeeding cutting device 4, a test piece finished with the cutting operation of the cutter 4 is fed to the longitudinal slitting device 5, and a test piece finished with the slitting operation of the slitting torch 5' is fed to the sorter 6. FIGS. 3A, 3B, and 3C illustrate several examples of patterns for test pieces 15', 15'', 15''' respectively, and FIG. 4 shows an arrangement of gas torches suitable for performing the cutting operation in cutter 4. FIG. 5 illustrates the positions of marking 17 and the positions of cutting 18 of a test piece 15.

Then, the completed test piece at the sorter 6 is classified into various kinds of material such as spare material, tension material, bending material and impact material. These various kinds of test pieces are put into the drop chute of the size corresponding to the width of the test pieces from the sorter 6. Thus, the test pieces are sorted according to the kinds thereof, and one cycle of the work of the tranfer machine is completed.

The output of the coincidence circuit 13 actuates the encoder 8, and the encoder 8 converts the input information from the card or tape unit 16 concerning the new test element on the material preparing stage 1 such as pattern number, thickness of the plate, marking letters and hardness of the material into an information signal, and that signal is stored in the memory device 9. When a new test piece element is fed on the conveyor 7 to the marking device 3 by way of the direction switching stage 2 from the material preparing stage 1 after the new test piece element is supplied to the direction switching stage 2 by the element supply device (not shown) of the material preparing stage 1 through the sequence circuit 12', simultaneously therewith, the information signal stored in the memory device 9 is shifted to the parallel shift register 10 giving an output to the decoder 11, the signal stored in this register is shifted to the register 10' giving an output to the decoder 11', the signal memorized in this register is shifted to the register 10'' giving an output to the decoder 11'', and the signal memorized in this last register is shifted to the register 10''' giving an output to the decoder 11'''. Consequently, the respective decoders 11 to 11''' read the new signals and according to this signal reading, the sequence circuits 12 perform the control of the work machines 3 to 6 for the test pieces transferred to the work machines 3 to 6 as mentioned above.

When the operations of the machines 3 to 6 are finished, a work complete signal is impressed independently on the coincidence circuit 13 from the respective machines, and when all the operations of the machines are finished, the output of the coincidence circuit 13 again operates to repeat the operation cycle of the signal transmission.

As to the operation of the second line system, just the same operation of said first line system is performed.

Further, in case that both the first and second line systems operate together, a priority determining circuit 14 is provided for improving the cycle time. This priority determining circuit 14 receives the output of the coincidence circuit 13 of the respective lines and uses the output as the drive input of the encoder 8, the direction switching stage 2 and the conveyer 7.

Therefore, in the case that the output of the coincidence circuit 13 of the second line is generated prior to the output of the first line because the operations in the second line have been finished earlier than that of the first line, the direction switch state 2 is driven to direct the next new test piece to the second line, and the output of the encoder 8 is stored in the memory device 9 of the second line through its respective steering AND gate 19. In the case that the work of the first line has been finished earlier than that of the second line, it will be readily understood that the operation will be reversed. The operation after the new test piece is fed into the line from the material preparing stage 1 is the same as that previously described and accordingly the detailed description thereof is omitted here.

Further it will be noted that a manual button may be used to supply input signals to the encoder 8 only when a test material or something like that is put into the line for one cycle of operations or when the card or tape input unit is out of order.

Figure 7:
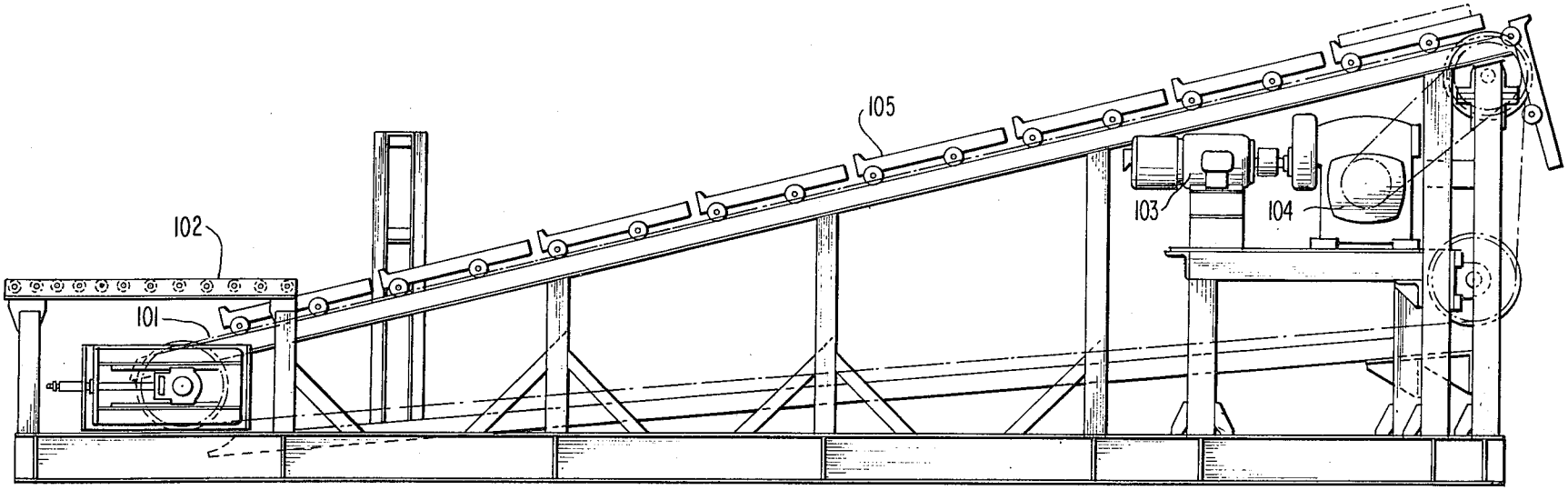
FIG. 7 is a side elevation view of a material preparation stage.

Referring to FIG. 7, the material preparation stage 1 as shown in FIG. 1 and FIG. 6 comprises a chain conveyor 101 which moves obliquely upwardly, and a horizontal conveyor 102. The conveyor 101 includes a plurality of trucks 105 connected thereto in series. There are four rows of such trucks, each of which can carry a plate. The rows of the trucks are adapted to be driven by a motor 103 and transmission 104 in such a manner that the trucks advance upwardly so as to deliver the plates one by one in each row to the direction switch state 2 as explained previously. The conveyor 102 is a conventional free roller type conveyor adapted to be manually loaded with plates which are successively delivered to the conveyor 101.

The direction switch stage 2 and the conveyor 7 are conventional motor driven conveyors. The direction switch stage 2 has a roller like carrying surface while the carrying surface of the conveyor 7 consists of rod like members extending in the direction of travel of the conveyor. The direction switch stage 2 is adapted to feed the material to the first or the second line upon delivering of the material from the stage 1 by a limit detector operated transfer device (not shown).

The selection as to whether the first line or the second line is fed with the material by the direction switch stage 2 is made by the priority determining circuit 14. The conveyor 7 covers the distance between the direction switch stage 2 and the sorting device 6. The range covered by the conveyor 7 involves a marking device 3, a lateral cutting device 4 and a longitudinal slitting or cutting device 5 which are approximately equally spaced along the conveyor 7. The plates are fed to the successive devices 3, 4, 5 and 6 during which the plates are delivered from one device to the next device upon detection of completion of the work in one device. The conveying of the plates from one device to the next device is of course carried out by the conveyor 7 which is adapted to be started and stopped upon detection of the completion of the work in respective device and the arrival to the next device, respectively.

Figure 8B:
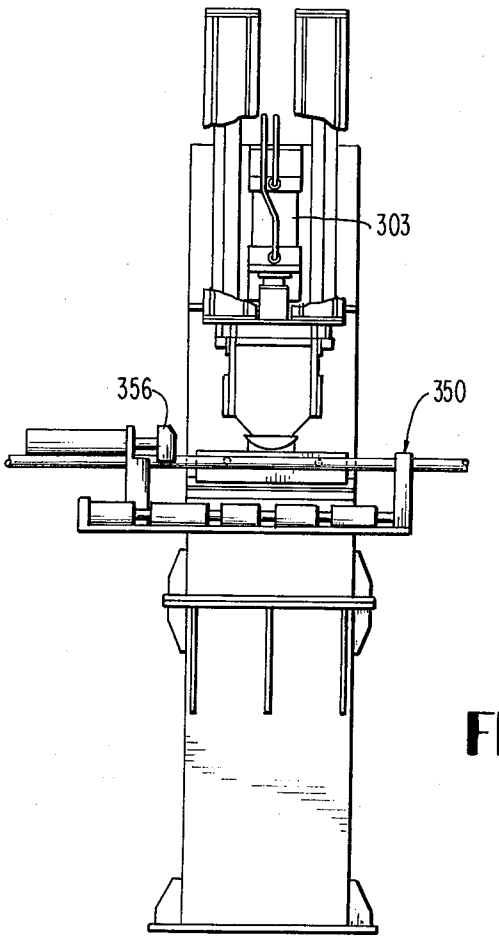
FIG. 8*b* is a side elevational view of the marking device in FIG. 8*a;*
Figure 8A:
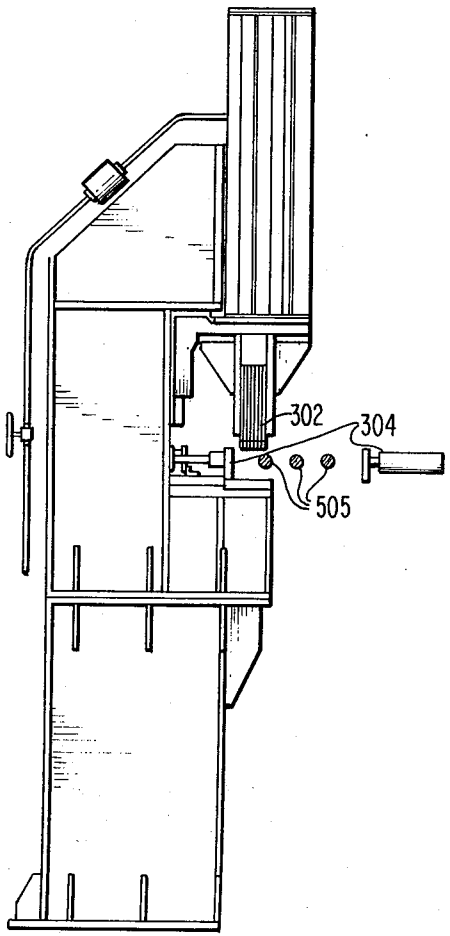
FIG. 8*a* is a front elevational view of a marking device.
Figure 9:
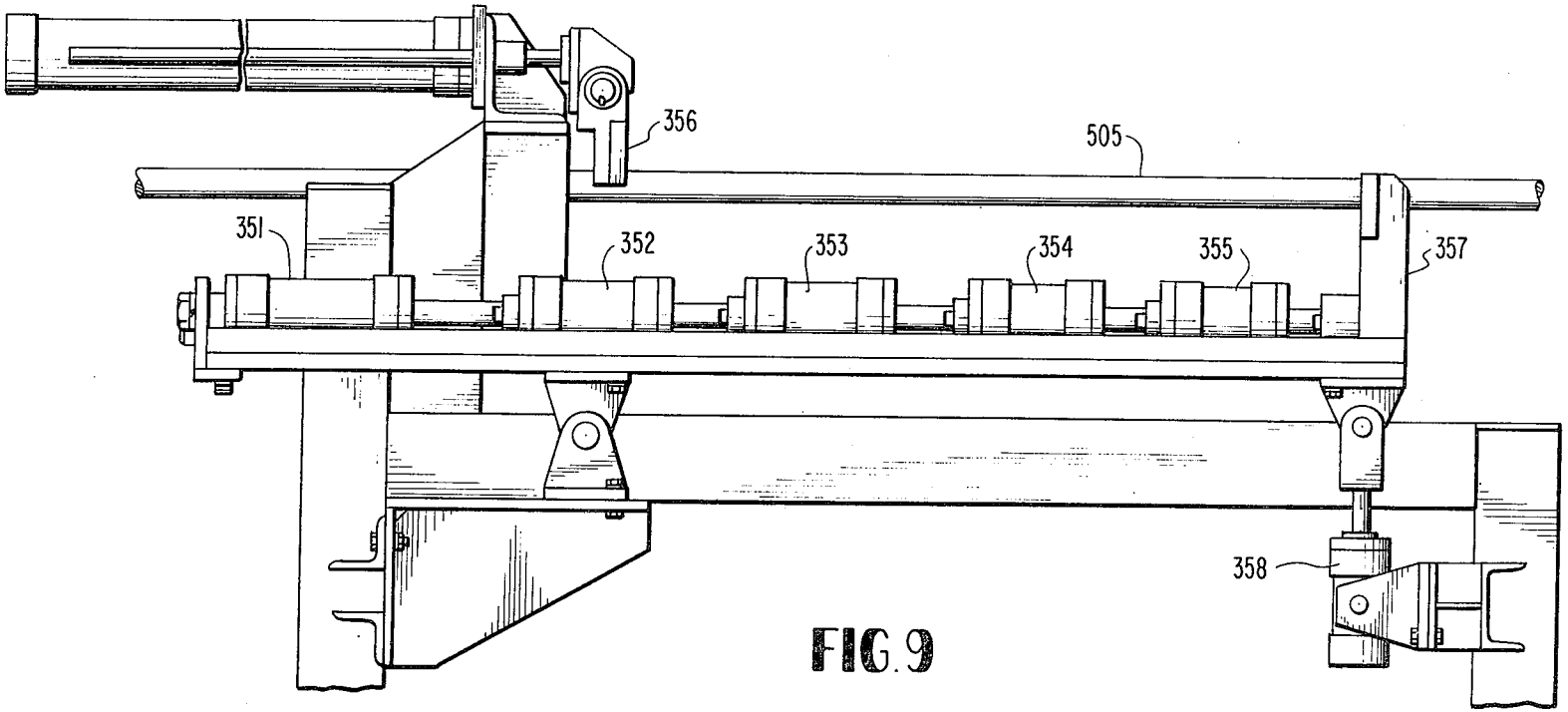
FIG. 9 shows a side elevation of a positioning means of the marking device.

Each marking device 3 is comprised of a main body 301 as shown in FIGS. 8*a* and 8*b* and a positioning means 350. The positioning means 350, which is more specifically shown in FIG. 9, includes five pneumatic cylinders 351–355 which are connected in series to form a binary cylinder means. The cylinders are combined with the conveyor in such a manner that their axes extend in the direction of the running of the conveyor. The test material which is roughly positioned by the stoppage of the conveyor is clamped between a movable plate 356 and a stopper plate 357 provided at the end of the binary cylinder means, and is then moved to the position for marking as illustrated by FIG. 5 upon controlled actuation of the binary cylinder means. A stopper cylinder 358 is provided for retracting the stopper 357 so as to prevent the later from being abutted by the material being conveyed.

The marking device has in its main body 301, five rotary plates each of which carries a plurality of types at its periphery. Thus, the five rotary letter and/or number plates in combination constitute a letter plate assembly 302. Each plate is rotated in accordance with the pattern order as illustrated in FIG. 2, in such a manner that the selected letter is brought to the lowermost position of the plate thereby forming an array of selected letters or numerals. The letter plate assembly 302 exhibiting the selected letters or numerals at its lower periphery is then lowered and pressed onto the plate by means of a hydraulic cylinder 303 so that the selected letters are marked in the plate surface. After the completion of one marking operation, the positioning means 304 is actuated again for new positioning of the plate in accordance with the preselected pattern as shown in FIG. 5 for further repetitive marking. In FIG. 8, the reference numeral 304 designate a positioning cylinder adapted for positioning of the plate in the direction transverse to the conveyor 7.

Figure 10:
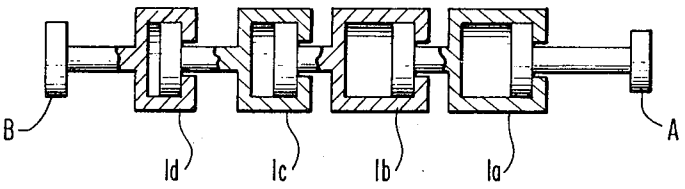
FIG. 10 is a schematic illustration for explaining the operation of a binary cylinder.

Referring to FIG. 10 which schematically shows the arrangement of the cylinders constituting the binary cylinder, each cylinder has its own piston which is connected to the neighboring cylinder so that the free end B of the binary cylinder makes a travel of a distance equal to the total of the strokes performed in respective cylinders. Thus, by selectively actuating the cylinders, various travels are obtained so that the letters or numerals in the letter plate assembly which have been selected will be imprinted on the plate at any position as required. The operation of the cylinders is controlled by means of electromagnetic switching valve means which serves to switch the working fluid for respective cylinders upon receipt of signals.

Figure 12:
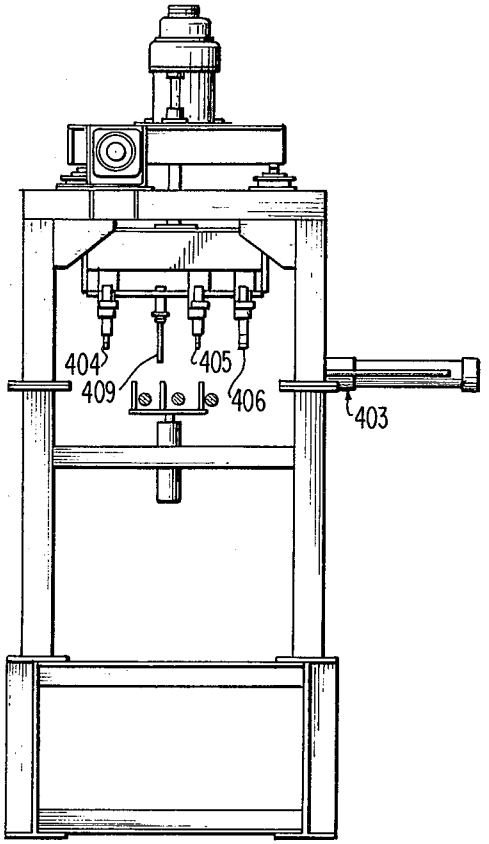
FIG. 12 is a side elevational view of the lateral cutting device as shown in FIG. 11.
Figure 11:
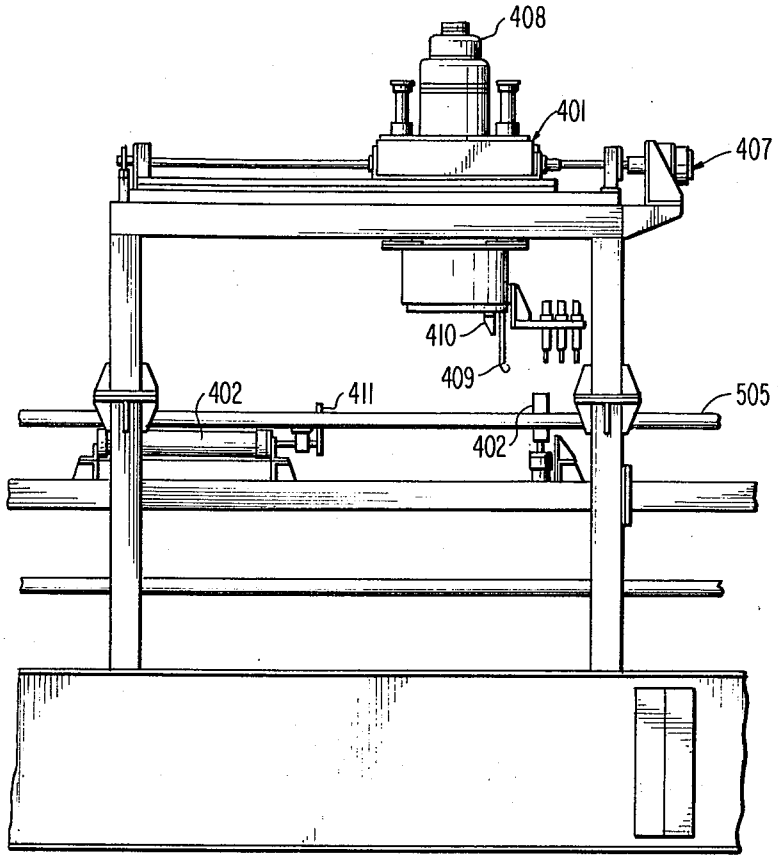
FIG. 11 is a front elevational view of a lateral cutting device.
Figure 4:
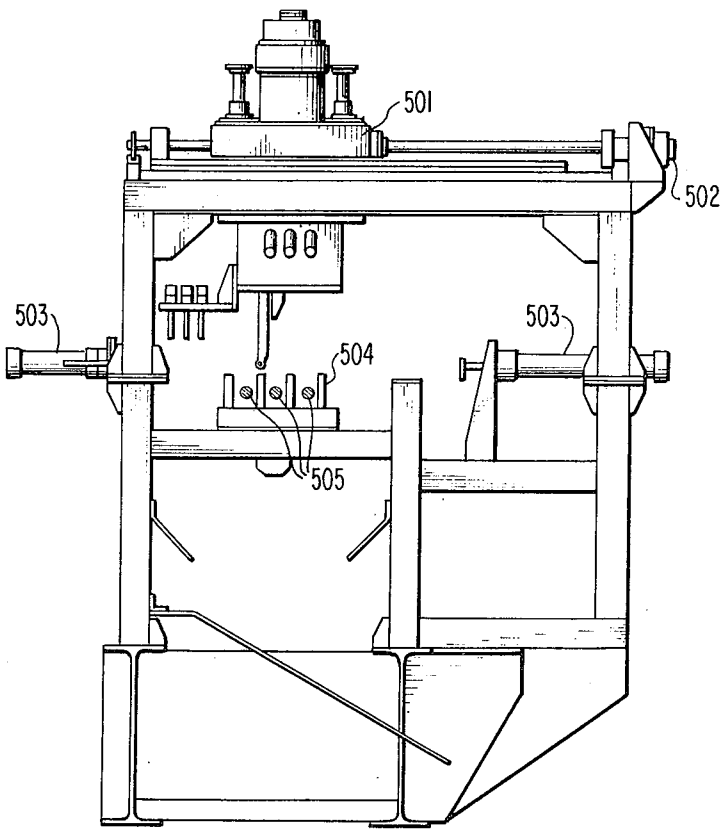

The lateral cutting device 4 is meant for cutting the opposing lateral sides of the samples so as to provide the samples with equal or uniform length. Referring to FIGS. 11 and 12, the lateral cutting device 4 comprises a carriage 401 on whivch a plurality of torches are mounted, and positioning and clamping mechanisms 402 and 403. There are provided three groups of torches 405 and 406 among which the torches 404 are for cutting one end of the samples while the torches 405 and 406 are for cutting the other ends of the samples at respective length of 300 mm and 450 mm. Each group of torches includes three torches of different sizes so that the suitable one may be selected in accordance with the thickness of the plate to be cut. Thus, the carriage 401 carries nine torches in all. The carriage 401 is moved in the direction of the conveyor by means of a driving motor 407 thereby cutting the lateral sides which are in parallel to the direction in which the conveyor runs, simultaneously. The motor 407 can operate at five different speeds, so as to provide optimum speed for respective thickness of the plates. The carriage 401 carries also a motor 408 for setting the height of the torches for varying the thickness of the plate, a level detecting rod 409 for detecting the level of the torches with respect to the plate and a pilot burner 410 which serves as an ignition source. The gas is fed to the torches through one of five pressure regulating valves adapted to serve the gas at respective pressure. This arrangement makes it possible to vary the gas pressure for five stages in accordance with the thickness of the plate and/or the speed of the carriage. The positioning and clamping means 402 includes a cylinder means having at its end a pushing plate 411, and a stopper opposing to the pushing claw for cramping the plate therebetween and for positioning the cramped plate in the direction in which the conveyor runs. The pushing plate and the stopper may be conveniently retracted when the conveyor is actuated to convey the plate, so as not to interrupt the movement of the plate.

Figure 3:
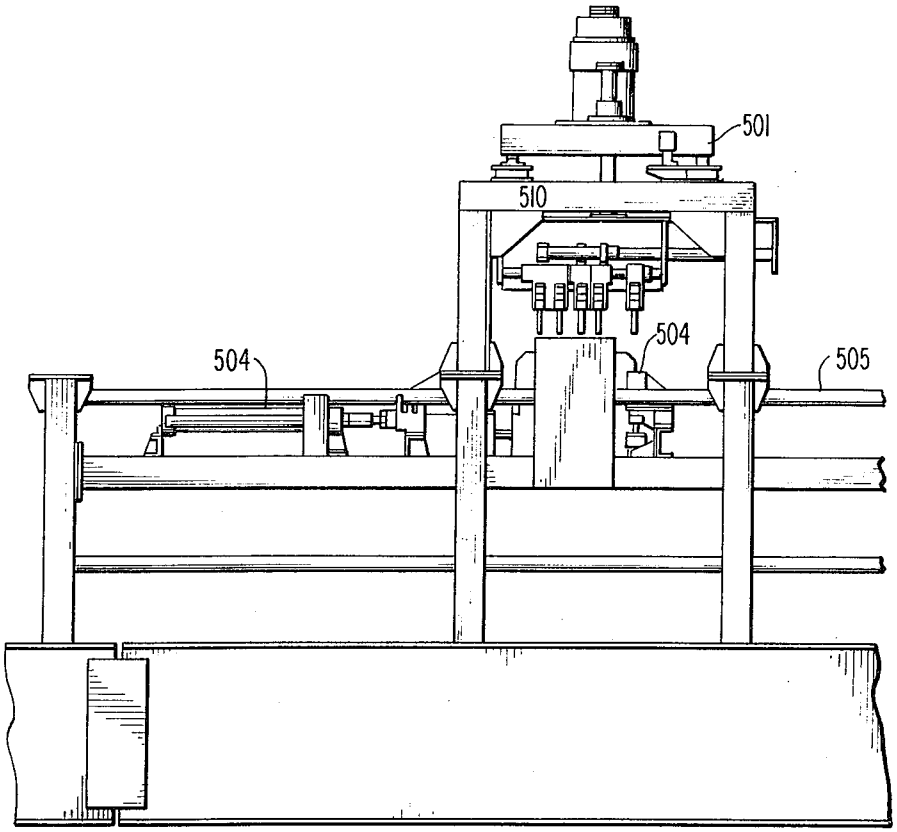

The longitudinal slitting or cutting device 5 is shown in FIGS. 13 and 14. This device is adapted for cutting the plate into a plurality of samples of varous widths as for example as shown in FIG. 3 which is determined depending on strength of the material or the testing condition, thereby providing test material samples for tensile test, bending test, and for impacting test, as well as spare samples.

Figure 15B:
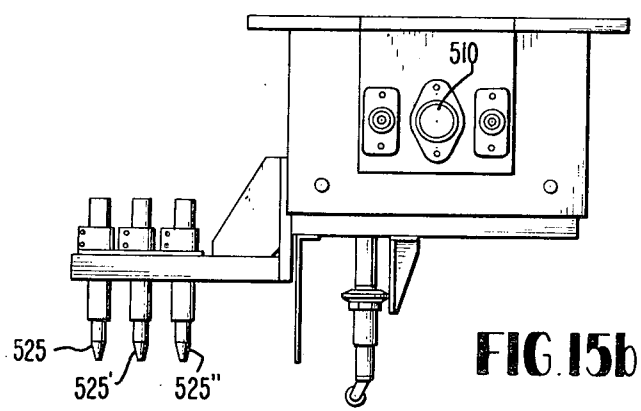
FIG. 15*b* is a side elevational view of the cutting device in FIG. 15*a;*
Figure 15A:
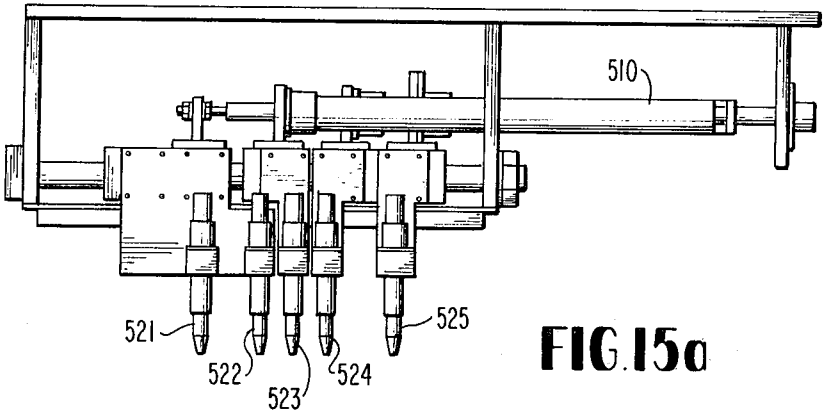
FIG. 15*a* shows torches combined with the binary cylinder as shown in FIG. 10.

The torches are arranged in five rows 521–525 to make five cuts simultaneously, each row involves three torches as for example torches 525, 525' and 526'' as seen in FIG. 15*b* of different sizes as was the case of the lateral cutting device 4. The torches are mounted on a carriage 501 which can move in the transverse direction of the conveyor by means of a variable speed driving motor 502 operable at five different speeds. Similarly to the lateral cutting device 4, the means for detecting the position of the carriage 501, the means for adjusting the level of the torch for varying thickness of the plate and the means for varying the pressure, i.e., the means for varying the flow rate of the gas are provided also in this longitudinal slitting device. In addition to those arrangement as common to the lateral cutting device, this longitudinal cutting device further includes a binary cylinder 510, as seen from FIG. 15*a*. This is for varying the distances between the neighboring rows of torches to provide for various widths of the samples in accordance with the predetermined pattern. Namely, each respective cylinder of the binary cylinder is connected to a respective torch holder so that each row may be positioned by the cylinder of the torch holder of the neighboring row, excepting the first two rows which are stationary and spaced apart a fixed distance.

The positioning and clamping means 503 are adapted for positioning the plate in the direction in which the cutting by the device 5 is effected, while the positioning and clamping means 504 of FIG. 13 are meant for effecting the positioning in the transverse direction of the samples. The components of the means 504 are accommodated by the conveyor and are retractable downwardly when the conveyor is actuated so as not to interrupt the movement of the plate. The bars 505 constituting the transferring surface of the conveyor which runs perpendicular to the direction of movement of the longitudinal slitting device are constructed from copper which is more resistant to the cutting gas flame.

Referring now to the sorting device 6 which is adapted to pick out the samples from the scraps, the cut material is advanced to the end of the conveyor and enters into a sorting carrier 601 which is shown in more detail in FIG. 17. A scraper 652 is pivotally supported by a work transferring feeding screw 651 so as to pivot in one direction to admit the material into the carrier but to prevent reverse movement of the material. As the complete receiving of the material by the carrier is detected, a driving motor 653 is started to advance the carrier 601 along a rail 602 until a chute lifting cylinder 654 (FIG. 17) reaches the position of a frame chute 603 of FIG. 16. Then, a work transferring motor 655 drives the feeding screw 651 to forward the material until the front end of the material arrives at a carrier chute 657 which arrival is detected by a detecting plate 656 adapted to detect the rotation of the feeding screw 651. The detecting plate 656 also initiates the chute lifting cylinder 654 and the carrier chute 657 is inclined so that the scrap on the carrier chute 657 may be disposed into the frame chute 603. The scrap is then collected at a scrap collecting pan (not shown). During this separation of the scrap, a clamping cylinder 658 clamps the sample adjacent the scrap being separated for otherwise the sample might be drawn into the chute along with the scrap, because it is possible that the oxidized particles produced during the gas cutting might bridge the gap between the sample and the scrap to lightly connect them together.

After the separation of the scrap, the motors 653, and 655 are started again to advance the carrier in accordance with the predetermined pattern indication until the chute lifting cylinder 654 is brought to the position of the next frame chute 604, and to forward the material until the first sample is positioned on the carrier chute 657 for ejection out through the frame chute 604. This sample is for tensile test. Then, similar steps are repeated to provide respective samples for a bending test and an impacting test, as well as a spare sample, to complete the sorting process.

The initial loading of the system with the plate is carried out manually. Namely, operators starts the conveyors 101 and 102 by means of a control console and puts the plate manually onto the conveyor 102. As the conveyor 102 advances, the front end of the plate engages the conveyor 101 and is delivered automatically thereto due to the frictional engagement. Then, the operator inputs the data such as pattern number, plate thickness and the indicia to be marked according to the types of the plate fed to the system, by means of a card, into the encoder 8.

The details of construction and operation of the marking devices, the cutters, the slitters and the sorters do not constitute a part of the present invention and are therefore only set forth to the extent necessary to show how such machines and their operations are compatible with the overall system described and claimed in the present application.

Although the present invention has been described with particular reference to an embodiment wherein two line systems and four works are incorporated in a mechanical test piece cutting and collecting work process, it will be understood that the present invention is not limited thereto but can be applied to various kinds of processes including a greater number of lines and machines.

As mentioned above, in accordance with the present invention, the work efficiency is enhanced and the uniformity of the products is preserved and work is further saved, which are great advantages in the field of industry.

What is claimed is:

1. A transfer machine system comprising a first line having a marking device, a lateral cutting device, a longitudinal slitting device, and a sorting device arranged at predetermined equal intervals on a conveyor, means responsive to the operation of each of said devices for intermittently advancing said conveyor by the distance corresponding to said intervals, means for supplying a sample steel plate on said conveyor each time said conveyor is intermittently advanced, and means controlling the operations of said devices so that the sample steel plate is mareked, cut and sorted according to a predetermined pattern and at least a second duplicate line of marking, lateral cutting longitudinal cutting and sorting devices arranged at predetermined equal intervals on at least a second conveyor, wherein said means for intermittently advancing said conveyor in said first line also intermittently advances at least said second conveyor on the basis of priority given the line where all operations have been completed by each device on the line subsequent to the last advance.

2. A transfer machine system as recited in claim 1 wherein said means for intermittently advancing said conveyors includes coincidence means for each line connected to sense the completion of operations by each device in the line, the priority means responsive to said coincidence means for advancing the conveyor corresponding to the line where all operations have been completed.

3. A transfer machine system as recited in claim 2 further comprising means for supplying encoded information defining a predetermined pattern for each sample steel plate, storage means for each line and responsive to said means for intermittently advancing said information in synchronism with the sample steel plate to which the information corresponds, and for decoding said information and supplying control signals to said means for controlling.

* * * * *